United States Patent [19]

Tagawa et al.

[11] Patent Number: 4,626,180

[45] Date of Patent: Dec. 2, 1986

[54] ROTARY COMPRESSOR WITH SPIRAL OIL GROOVES FOR CRANKSHAFT

[75] Inventors: Shigetaro Tagawa; Mitsuru Murata; Kazuo Sekigami; Masahiko Sugiyama; Gen Konno, all of Tochigi, Japan

[73] Assignee: Hitachi, Ltd., Tokyo, Japan

[21] Appl. No.: 634,557

[22] Filed: Jul. 26, 1984

[30] Foreign Application Priority Data

Jul. 29, 1983 [JP] Japan ..... 58-137520

[51] Int. Cl.[4] ..... F04C 29/02; F01M 1/06

[52] U.S. Cl. ..... 418/63; 418/88; 418/94; 184/6.16

[58] Field of Search ..... 418/88, 94, 63; 184/6.16, 6.5; 417/366, 368

[56] References Cited

U.S. PATENT DOCUMENTS

| | | | |
|---|---|---|---|
| 2,476,383 | 7/1949 | Porteous | 418/63 |
| 3,130,902 | 4/1964 | Brown | 418/63 |
| 3,499,600 | 3/1970 | McGregor | 418/94 |
| 3,513,476 | 5/1970 | Monden et al. | 418/88 |

FOREIGN PATENT DOCUMENTS

| | | | |
|---|---|---|---|
| 57-181986 | 11/1982 | Japan | 418/94 |
| 58-65993 | 4/1983 | Japan | 418/94 |

*Primary Examiner*—John J. Vrablik

*Attorney, Agent, or Firm*—Antonelli, Terry & Wands

[57] ABSTRACT

A rotary compressor has a main bearing and a sub-bearing which are disposed on both sides of a cylinder, and a vane which is inserted at an eccentric crank pin portion of a crankshaft and is adapted to reciprocate while being in contact at one end thereof with a roller eccentrically rotating inside the cylinder. An oil feeding mechanism for the rotary compressor comprises: an oil feeding hole provided in a portion of the crankshaft closer to the end surface of a sub-journal of the crankshaft; an oil hole provided in a crank pin portion of the crankshaft such as to communicate with both the oil feeding hole and an oil groove formed on the crank pin portion; a spiral oil groove formed in the outer periphery of a main journal of the crankshaft such as to spiral in the direction opposite to the rotational direction of the crankshaft; and a spiral oil groove formed in the outer periphery of the sub-journal of the crankshaft such as to spiral in the same direction as the rotational direction of the crankshaft.

2 Claims, 10 Drawing Figures

Pd > Ps

ROTARY COMPRESSOR WITH SPIRAL OIL GROOVES FOR CRANKSHAFT

BACKGROUND OF THE INVENTION

1. Field of the Invention

The present invention relates to a rotary compressor and, more particularly, to a rotary compressor having an oil groove provided in the journal portion of the crankshaft thereof.

2. Description of the Prior Art

First of all, a conventional rotary compressor (hereinafter referred to simply as "compressor") will be described hereinunder with reference to FIG. 1 which is a vertical sectional view of a known rotary compressor. The conventional rotary compressor has a curved oil feeding pipe 9 which is immersed in an oil 10 stored in the lower part of a casing 1. The oil feeding pipe 9 is provided therein with a coiled spring 8 which rotates with a crankshaft 7. The oil is transferred to the end portion of the crankshaft 7 on the side thereof which is closer to the coiled spring 8 through the leads of the coiled spring 8. The oil then passes through oil grooves 7A, 7B and 7C which are respectively formed in the outer peripheries of a sub-journal 7S, a crank pin 7*b* and a main journal 7M of the crankshaft 7 thereby to lubricate these slide portions. The compressor of this type, however, suffers the following disadvantages: The oil grooves 7A and 7C respectively provided on the sub-journal 7S and the main journal 7M of the crankshaft 7 need to be formed such as to spiral in the direction opposite to a rotational direction 13 of the crankshaft 7 as shown in FIGS. 1 and 2 in order that the oil is forcedly transferred from the end portion of the sub-journal 7S of the crankshaft 7 to the main journal 7M thereof aided by the pitch angle between the oil grooves 7A and 7C. For this reason, as shown in FIG. 3, it is not possible to provide the oil groove 7A on the subjournal 7S such that the oil groove 7A is not located in a portion of the sub-journal 7S which is heavily subjected to a load 16 applied to the crankshaft 7 as a reaction force to a force on the crankshaft due to the fluid pressure in the cylinder during the operation of the compressor. Consequently, the area for receiving a maximum load is reduced by an amount corresponding to the area of the oil groove 7A which fact causes the surface pressure at the oil groove 7A on the sub-journal 7S to be greatly increased, so that the sub-journal 7S may cause seizure or other failure. Thus, there is a strong possibility of deterioration in the compressor's reliability. Further, the gap at the slide portion of a roller 11 is sealed by the oil which is supplied thereto after being heated at the sub-journal 7S. In other words, the gap is sealed by the oil which is lowered in viscosity and, therefore, sealing properties are impaired, resulting disadvantageously in a reduction in volumetric efficiency of the compressor.

It is to be noted that the reference numerals 4, 5 and 6 in FIG. 1 respectively denote a spring, a vane and a cylinder.

FIG. 4 is a vertical sectional view of a conventional known compressor of the type wherein oil grooves 3A and 12A are respectively formed in the inner peripheries of a main bearing 3 and a sub-bearing 12. By the pumping action of the vane 5 vertically moving, the oil is sucked in from a small bore 14*a* opened in a portion of an oil feeding pipe 14 immersed in the oil 10. The oil is passed through the oil feeding pipe 14 and is supplied into an oil feeding hole 7*d* defined by the inner periphery of the crankshaft 7 from the end portion of the sub-journal 7S on the side thereof which is closer to the oil feeding pipe 14. Then, the oil is fed to the sub-journal 7S, the crank pin 7*b* and the main journal 7M through oil holes 7*e*, 7*f* and 7*g* which provide communication between the oil feeding hole 7*d* and the outer peripheries of the sub-journal 7S, the crank pin 7*b* and the main journal 7M, thereby to lubricate the slide portions while passing through the oil grooves 3A and 12A respectively provided on the inner peripheries of the main bearing 3 and the sub-bearing 12. This type of oil feeding mechanism, however, cannot effect the forced oil feeding by means of the oil grooves 3A and 12A, since they are fixed. Moreover, since there are changes in the amount of oil fed to the oil holes 7*e*, 7*f* and 7*g*, particularly when the amount of oil fed by the pumping action is small, imbalance is disadvantageously easily produced between the supplies of oil to the main bearing 3 and the sub-bearing 12.

SUMMARY OF THE INVENTION

Accordingly, it is a primary object of the present invention to provide a highly reliable and efficient compressor which is made free from the above-described disadvantages of the prior art.

To this end, according to the invention, oil grooves are respectively provided in outer peripheral portions of the main journal and the sub-journal, which are lightly subjected to the loads applied to the journals, thereby to improve reliability and to allow the crank pin to be lubricated with oil which is low in temperature and high in viscosity.

The above and other objects, features and advantages of the invention will become clear from the following description of the preferred embodiment thereof, taken in conjunction with the accompanying drawings.

DESCRIPTION OF THE PREFERRED EMBODIMENT

Figure 1:
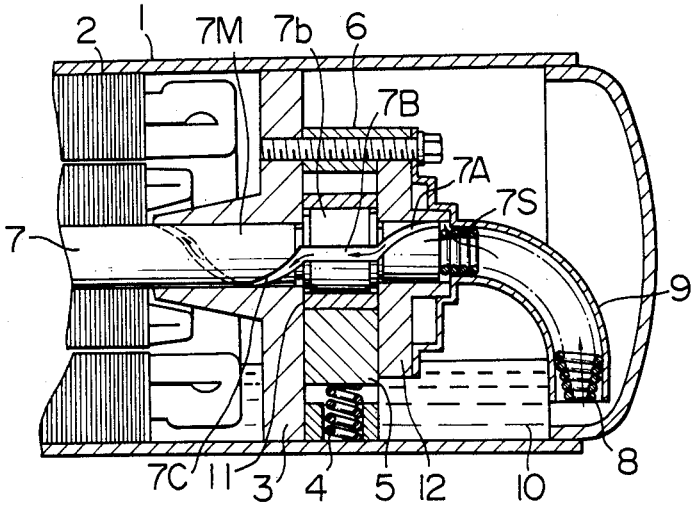
FIG. 1 PRIOR ART
FIG. 1 is a vertical sectional view of a known conventional rotary compressor.
Figure 2:
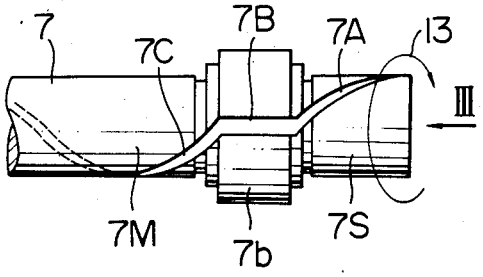
FIG. 2 PRIOR ART
FIG. 2 is an illustration of the crankshaft of the compressor shown in FIG. 1.

One embodiment of the present invention will be described hereinunder with reference to FIGS. 5 to 7.

A casing 1 accommodates an electrically-operated element 2 and a compression element therein and stores an oil 10 in the low part thereof. The compression element is composed of a cylinder 6, a crankshaft 7 driven by the electrically-operated element 2, a roller 11 driven by the crankshaft 7 such as to eccentrically rotate inside the cylinder 6, a vane 5 which reciprocates while contacting the roller 11, and a main bearing 3 and a sub-bearing 12 which are respectively disposed on both sides of the cylinder 6 and are adapted to support the crankshaft 7 rotatably. The vane 5 is disposed such as to vertically move in a direction substantially perpendicular to the horizontal surface of the oil 10. The main bearing 3 has its lower part immersed in the oil 10 such as to form at the rear of the vane 5 a practically hermetically sealed space 15 filled with the oil. Further, at the rear of the vane 5 is disposed a spring 4 which constantly urges the vane 5 toward the roller 11. The oil is fed as follows: As the vane 5 vertically moves, the oil is sucked in from a tapered suction piece 3B provided in the lower part of the main bearing 3 and is discharged from a delivery-side tapered bore 12B formed in the sub-bearing 12 and is then led through an oil flow passage 13 to the end portion of the crankshaft 7 on the side thereof which is closer to the oil flow passage 13. The oil then enters an oil hole **7*d* opened in the end portion of the crankshaft 7 and is discharged from an oil hole 7*f* provided in a crank pin 7*b* by means of the centrifugal force of the crankshaft 7. After lubricating the crank pin 7*b*, the oil separates into two directions, that is, toward an oil groove 7A formed on the outer periphery of a subjournal 7S and an oil groove 7C formed in the outer periphery of a main journal 7M to lubricate the main bearing 3 and the sub-bearing 12. The oil which has lubricated the sub-bearing 12 is collected in the end portion of the crankshaft 7, while the oil which has lubricated the main bearing 3 is discharged into the casing 1 from the end portion of the main bearing 3 on the side thereof which is closer to the electrically-operated element 2. Thus, the oil which is low in temperature and high in viscosity lubricates the crank pin 7*b*. Therefore, the cylinder 6 and the roller 11 are cooled, and the sealing properties of the slide part of the roller 11 are improved such as to increase the volumetric efficiency, so that it is possible to obtain a compressor of high efficiency. As shown in FIGS. 5 to 7, the oil groove 7C on the main journal 7M is formed such as to spiral in the direction opposite to the rotational direction of the crankshaft 7, while the oil groove 7A on the sub-journal 7S is formed such as to spiral in the same direction as the rotational direction of the crankshaft 7. Therefore, it is possible to provide the oil groove 7A such that it is not located in a portion of the sub-journal 7S which is heavily subjected to the load applied to the sub-journal 7S as discussed more fully below with reference to FIGS. 8–10. Thus, the surface pressure can be lowered, and the subjournal 7S** can be improved in reliability.

Figure 5:
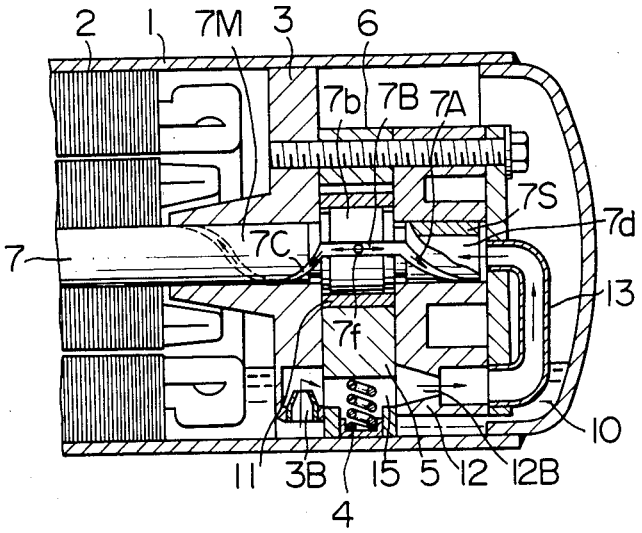
FIG. 5 is a vertical sectional view of one embodiment of the compressor in accordance with the present invention.
Figure 6:
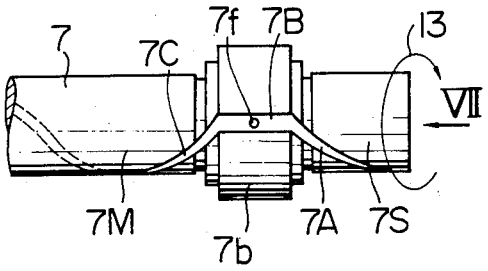
FIG. 6 is an illustration of the crankshaft of the compressor shown in FIG. 5.
Figure 7:
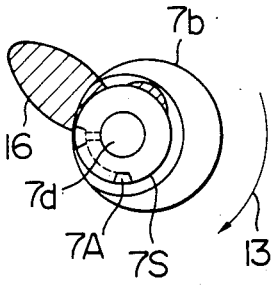
FIG. 7 is a side elevational view of the crankshaft shown in FIG. 6 as viewed in the direction of the arrow VII in FIG. 6, showing the distribution of the load applied to the sub-journal portion of the crankshaft.
Figure 8:
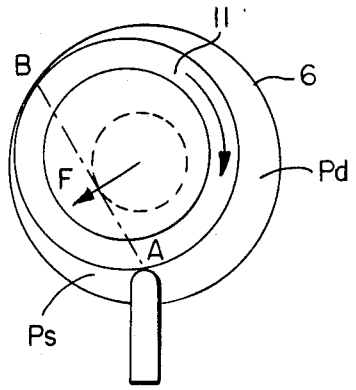
FIG. 8 is a schematic, transverse sectional view of the rotary compressor of FIG. 5 which indicates the relation of the positions of the cylinder, roller, crankshaft and the vane in the compressor and the force F caused by the fluid pressure within the cylinder of the compressor during operation of the compressor.

By way of explanation, FIG. 8 shows a schematic, transverse sectional view which indicates the relation of the positions of the cylinder, the roller, the crankshaft and the vane in the rotary compressor of the invention as illustrated in FIGS. 5–7. As shown in FIG. 8, a force F is applied to the crank pin **7*b* of the crankshaft 7 by way of the roller 11. The force F is caused by the fluid pressure within the cylinder 6 of the compressor during operation of the compressor. The force F acts in a direction at a right angle to a straight line extending between a point A where the vane 5 contacts the roller 11 and the point B where the roller contacts the cylinder. The force is generated by the pressure difference between the delivery pressure Pd and the suction pressure Ps in the respective chambers of the compressor on opposite side of the vane 5 between the roller 11 and the cylinder 6** as Pd is greater than Ps.

Figure 9:
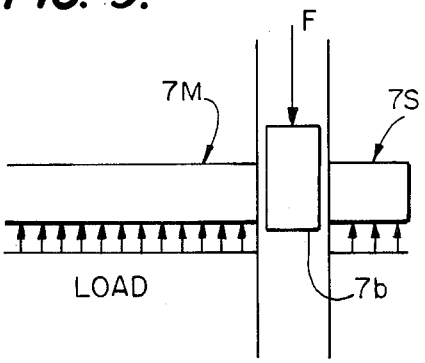
FIG. 9 is a schematic illustration of the crankshaft with the reaction forces thereon from the force F in the theoretical case the main journal and the sub-journal were completely rigid.
Figure 10:
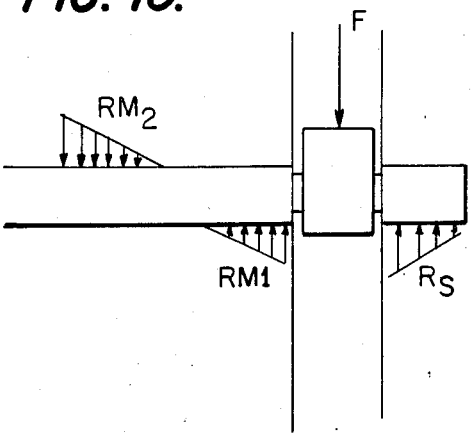
FIG. 10 is a schematic illustration of the crankshaft with the loads $RM_1$, $RM_2$ and Rs being illustrated, which loads are in practice applied on the crankshaft by the main bearing and sub-bearing as reaction forces against the force F.

Theoretically, if the main journal 7M and the sub-journal 7S of the crankshaft 7 were completely rigid, both journals would be uniformly loaded as shown in FIG. 9. However, in practice the journals do not have the property of complete rigidity. Therefore, loads $RM_1$ $RM_2$ and Rs are applied on the crankshaft by the main bearing 3 and sub-bearing 12 as reaction forces against the force F as shown in FIG. 10.

Figure 3:
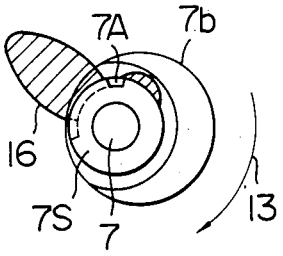
FIG. 3 PRIOR ART
FIG. 3 is a side elevational view of the crankshaft shown in FIG. 2 as viewed in the direction of the arrow III in FIG. 2, showing the distribution of the load applied to the sub-journal portion of the crankshaft.
Figure 4:
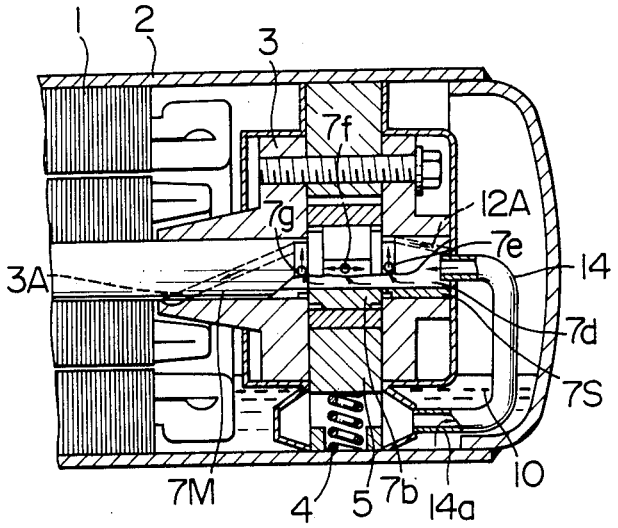
FIG. 4 PRIOR ART
FIG. 4 is a vertical sectional view of another known conventional compressor.

The loads $RM_1$, $RM_2$ and Rs act on both journals as the reaction forces. However, the magnitudes and the positions of these forces acting on the journals are changed according to the rotation of the roller. As a result of this, the load 16 is generated as a partial pattern as shown in FIGS. 3 and 7 of the drawings. It can be seen that the load 16 is properly in a partial pattern because the crank pin **7*b*** is at an eccentric portion of the crankshaft, so that the rotation of the pin is eccentric. The existance and causation of these loads acting on both journals of the crankshaft are known to those skilled in the art of rotary compressors.

As has been described above, the present invention makes it possible to provide the oil grooves 7C and 7A on respective portions of the main journal 7M and the sub-journal 7S of the crankshaft 7 which are only lightly subjected to the loads applied to the journals. Accordingly, the main bearing 3 and the sub-bearing 12 can be improved in reliability. Further, since the oil is concentratedly supplied to the bearing portions from the oil hole **7*f* provided in the crank pin 7*b* of the crankshaft 7, the roller 11 and the cylinder 6** are cooled and sealed by oil which is low in temperature before being heated by the slide portions and is consequently high in viscosity. Accordingly, a gas having a large specific volume is compressed, and leakage of the compressed gas is reduced, so that the compressor is increased in volumetric efficiency. Thus, it is possible to market a compressor of high efficiency.

What is claimed is:

1. A rotary compressor comprising a cylinder, a main bearing and a sub-bearing located on respective sides of said cylinder, a crankshaft extending through said cylinder, a crankshaft extending through said cylinder, said crankshaft having a crank pin positioned within said cylinder for rotation, a main journal and a sub-journal rotatably supported in said main bearing and said sub-bearing, respectively, means in the cylinder operatively associated with the crankshaft for compressing a fluid in the cylinder during operation of said compressor, portions of said main journal and sub-journal being heavily subjected to a load from reaction forces by the main bearing and sub-bearing, respectively to a force applied to the crankshaft as a result the fluid pressure in said cylinder during operation said compressor, electrically operated means for rotating said crankshaft in a predetermined direction, a first spiral oil groove provided in the outer periphery of the main journal of the crankshaft and a second spiral oil groove provided in the outer periphery of the sub-journal of the crankshaft, means for supplying oil to said oil grooves during operation of said compressor, wherein the first oil groove is formed so as to spiral in a direction opposite to the rotational direction of the crankshaft and the second oil groove is formed so as to spiral in the same direction as the rotational direction of the crankshaft, and wherein both the first and second oil grooves are not provided in said portions of the corresponding journals which are heavily subjected to said load.

2. A rotary compressor according to claim 1, wherein said means for supplying oil comprises an oil hole communicating with a supply of oil and providing in a portion of said crankshaft closer to the end surface of said sub-journal such as to communicate with an oil groove provided in the crank pin portion of said crankshaft.

* * * * *